US007976246B1

(12) United States Patent
Krabbendam

(10) Patent No.: US 7,976,246 B1
(45) Date of Patent: Jul. 12, 2011

(54) SYSTEM FOR DEPLOYING A DEEPWATER MOORING SPREAD

(75) Inventor: Richard L. Krabbendam, Rotterdam (NL)

(73) Assignee: Kahn Offshore B.V., Rotterdam (NL)

( * ) Notice: Subject to any disclaimer, the term of this patent is extended or adjusted under 35 U.S.C. 154(b) by 420 days.

(21) Appl. No.: 12/357,955

(22) Filed: Jan. 22, 2009

(51) Int. Cl.
*E02D 5/54* (2006.01)

(52) U.S. Cl. ..... 405/224; 414/142.6; 405/172; 405/195.1; 114/230.1

(58) Field of Classification Search ..... 405/154.1, 405/158, 224, 228, 231, 232, 244, 249; 414/139.4, 414/139.8, 140.3, 141.3–141.6, 142.6–142.7; 114/230.1
See application file for complete search history.

(56) References Cited

U.S. PATENT DOCUMENTS

| | | | | |
|---|---|---|---|---|
| 3,640,400 | A * | 2/1972 | Becraft | 212/311 |
| 3,716,154 | A * | 2/1973 | Berg et al. | 414/803 |
| 6,457,908 | B1 * | 10/2002 | Bergeron | 405/224 |
| 6,964,552 | B1 * | 11/2005 | Krabbendam | 414/803 |

FOREIGN PATENT DOCUMENTS

EP 59648 A * 9/1982

* cited by examiner

*Primary Examiner* — Gregory W Adams
(74) *Attorney, Agent, or Firm* — Buskop Law Group, PC; Wendy Buskop

(57) ABSTRACT

A system for deploying a deepwater mooring spread from a floating vessel using at least two cranes each having a main block, a deepwater deployment system connected to at least one of the cranes, a reel drive, a structure for supporting the reel drive and a hang-off, a plurality of neutral buoyancy polymer lines deployable by the reel drive connectable to each other and the hang-off with chains and/or with remote operated vehicle connectors, at least two suction piles with anchor chains, and at least two buoys, one for each suction pile for connecting to the neutral buoyancy polymer lines.

9 Claims, 13 Drawing Sheets

SYSTEM FOR DEPLOYING A DEEPWATER MOORING SPREAD

FIELD

The present embodiments relate to a method for deploying a deepwater mooring spread from a heavy lift vessel using a staged neutral buoyancy polymer line deployment system.

BACKGROUND

A need exists for a system for deploying moorings in very deep water using a system of polymer lines and buoys for faster deployment than current techniques.

A deepwater deployment system is described in Applicant's U.S. Pat. No. 6,964,552 and is incorporated herein by reference.

A further need exists for a system for deploying suction piles in deep water using two heavy lift cranes that is systematic and does not cause any chafing on the edge of a floating vessel.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

The present embodiments generally relate to a system for deploying a deepwater mooring spread from a floating vessel with a deck, using an aft crane secured to a port side or a starboard side of the floating vessel, and a fore crane secured to the port side or starboard side of the floating vessel. The floating vessel can be a heavy lift vessel.

One of the benefits of this system is the ability to deploy heavy structures to almost unlimited water depths by using a polymer line as a temporary lift pennant, the lift pennant can be a mooring line as well.

Figure 1:
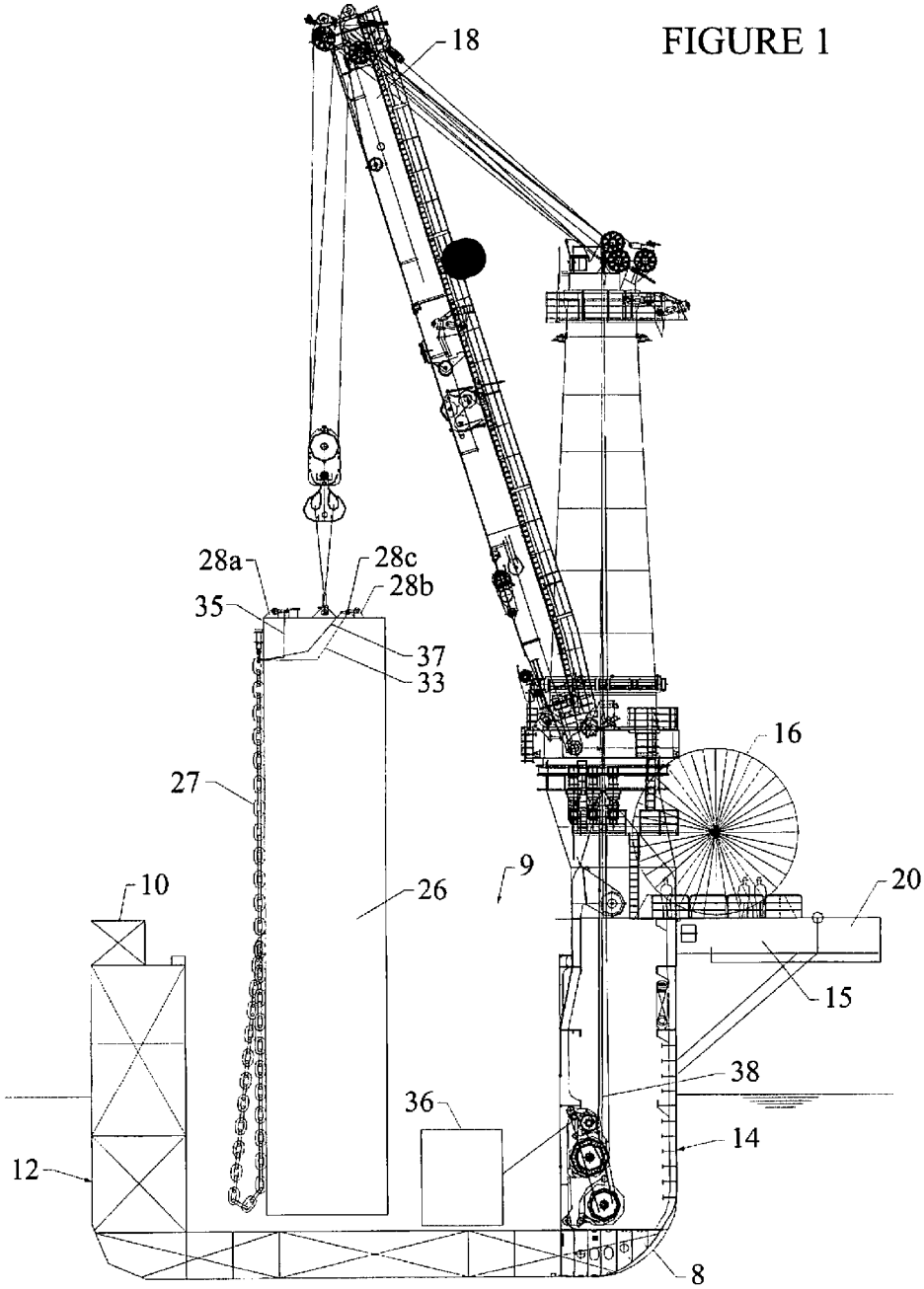
FIG. 1 is a cross sectional view of a floating vessel using the inventive system wherein an aft crane has lifted a suction pile from the hold of a floating vessel.

Turning now to the Figures, FIG. 1 shows a cross section of a floating vessel usable in the system for deploying deep water moorings for water depths ranging from about 50 meters to about 1500 meters or more.

A floating vessel 8, is shown with a hold 9 which can accommodate a suction pile 26. Additional suction piles and anchors can be accommodated in the hold 9. In addition, the suction piles can be oriented horizontally or vertically.

In an embodiment the suction piles or anchors can be on the deck 10 of the floating vessel 8, which can be a heavy lift ship with bow and stern, a barge with cranes with or without propulsion, or another types of movable vessels.

In this embodiment, the suction piles can be vertically arranged in the hold for ease of lifting by cranes secured to the starboard side or port side of the hull of the floating vessel 8. For example, between 1 suction pile to 18 suction piles can be used to create the deepwater mooring spread of this novel system. Any number can be deployed as long as all the suction piles or anchors fit on or in the floating vessel.

Figure 2:
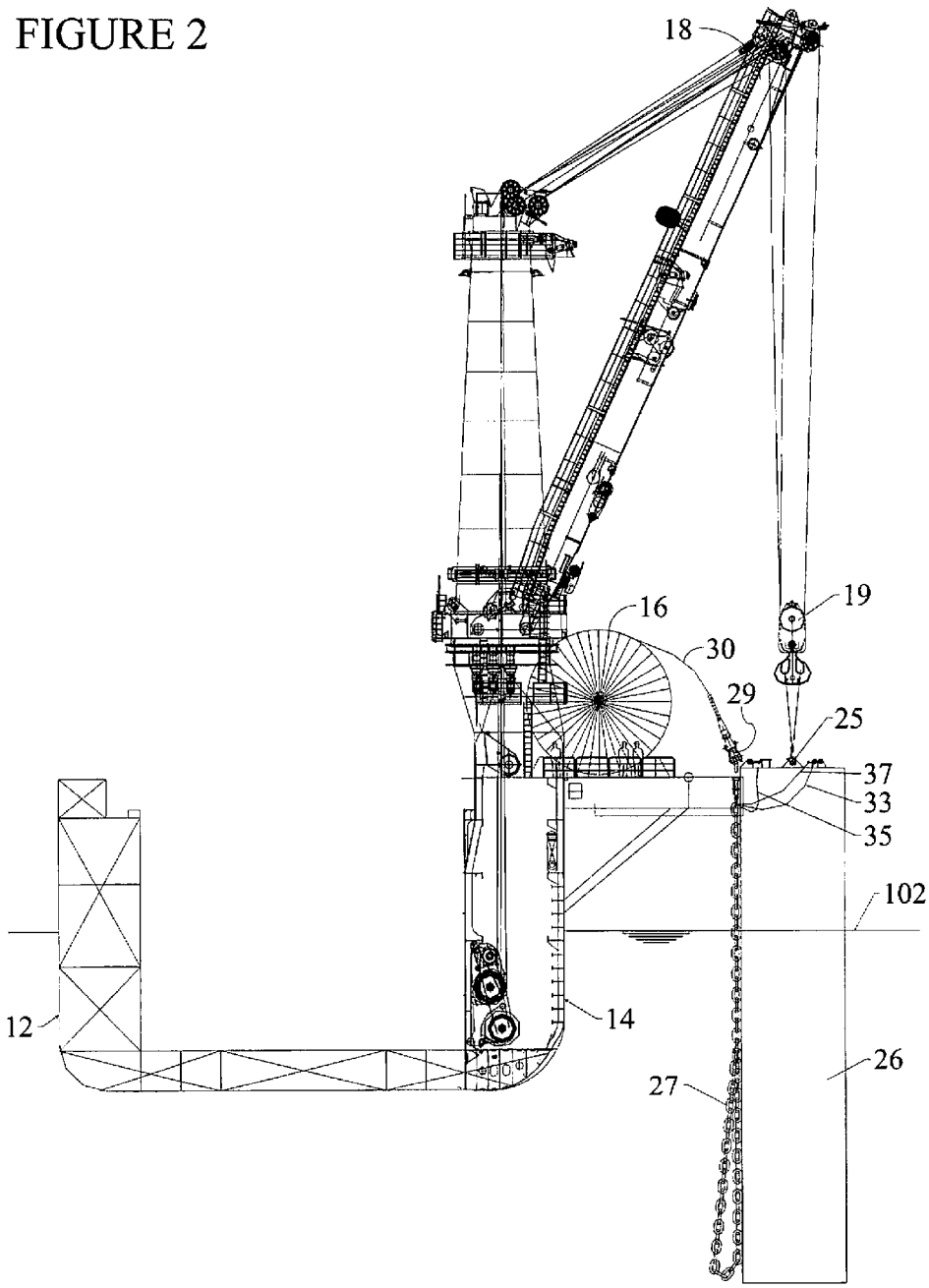
FIG. 2 is a cross sectional view of a floating vessel with the suction pile overboarded into water supported by the aft crane and connected to one end of a first polymer line.

The floating vessel can have a length between about 60 meters to about 400 meters, and a weight of between about 3000 tons to about 50,000 tons when empty Each suction pile anchor chain 27 can be connected with a pad eye at the lower side of the suction pile 26, or anchor. At the other side of the suction pile anchor chain 27 can be a remote operated connector 29, which can connect the suction pile anchor chain 27 to the polymer line, which is shown in FIG. 2.

Returning to FIG. 1, the suction pile 26 is shown with three pad eyes 28*a*, 28*b* and 28*c*. To these pad eyes can be connected a first lift sling 33, a second lift sling 35 and a third lift sling 37, which can be connected to the end of the suction pile anchor chain 27.

The floating vessel can have two cranes, a fore crane not shown in this Figure, and an aft crane 18. The order of use of the cranes can be reversed in another embodiment of this system.

These cranes can be pedestal cranes or mast cranes such as those made by Huisman-Itrec located near Rotterdam, the Netherlands or any other manufacturer. The cranes notably have the features of being able to lower loads to water depths of at least 800 meters by use of a deepwater deployment system, comprised of a winch in the lower hold with the lifting wire of between about 2000 meters to about 25000 meters guided via sheaves to the jib head of the crane and lift tackle.

FIG. 1, further shows the deepwater deployment system 36 with deepwater deployment line 38. The deepwater deployment line can further be a lifting wire.

A load bearing structure 15 can be connected to an outboard starboard side 14 in FIG. 1. However, in another embodiment, the load bearing structure 15 can be connected to an outboard port side 12 if at least one crane was located on the port side of the floating vessel 8.

Secured to the load bearing structure 15 can be a hang-off 20 for securing, removably, one or more polymer lines deployed with this system. The load bearing structure 15 can be a steel plate that can be reinforced with steel brackets. For example, the load bearing structure 15 can be a perforated steel plate that can be powder coated having a length of between about 6 meters to about 20 meters, a width of between about 2 meters to about 10 meters and a thickness of between about 0.5 meters to about 1.5 meters, such as a tweendeck hatch cover or any other load bearing structure.

A reel drive 16 can be fixedly secured to the load bearing structure 15. The reel drive 16 can be used for deploying at least one, and up to 6 polymer lines for a single mooring line.

FIG. 2 shows the aft crane 18 having lifted the suction pile 26 from the hold and partially lowered into water 102 on the starboard side of the floating vessel.

In this FIG. 2, a first polymer line 30 is shown coming off the reel drive 16.

The aft crane main block 19 is shown supporting the suction pile 26 at the first remote operated shackle 25.

The first polymer line 30 is shown connected while the suction pile top is out of the water, to remote operated connector 29 while the suction pile anchor chain 27 is shown connected to the first lift sling 33, the second lift sling 35 and third lift sling 37.

Figure 3:
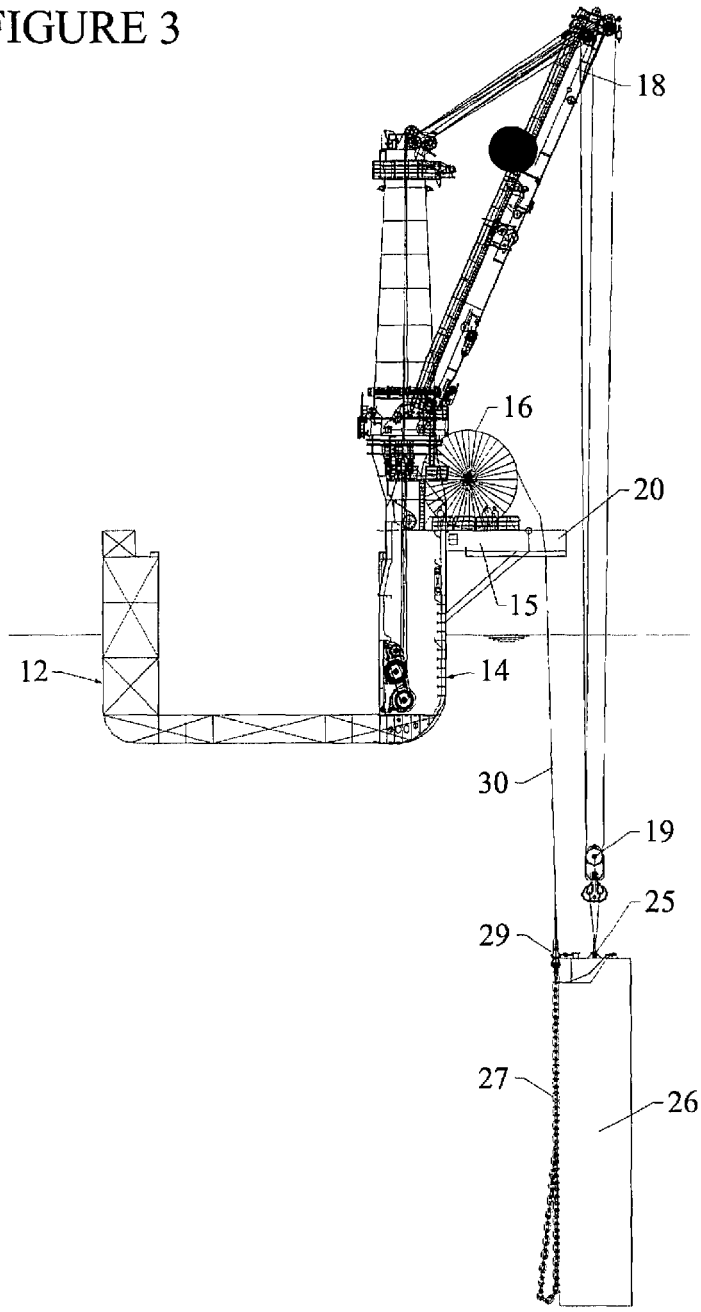
FIG. 3 shows a cross sectional view of a floating vessel with the suction pile lowered into the water connected to the first polymer line.

FIG. 3 shows the suction pile 26 being lowered by the aft crane 18 into the water 102, below the water line towards the sea floor, which is not shown in this Figure. The suction pile is lowered by the aft crane main block 19. Simultaneously while the suction pile 26 is lowered, the reel drive 16 deploys the first polymer line 30 with one end connected to the remote operated connector 29.

Figure 4:
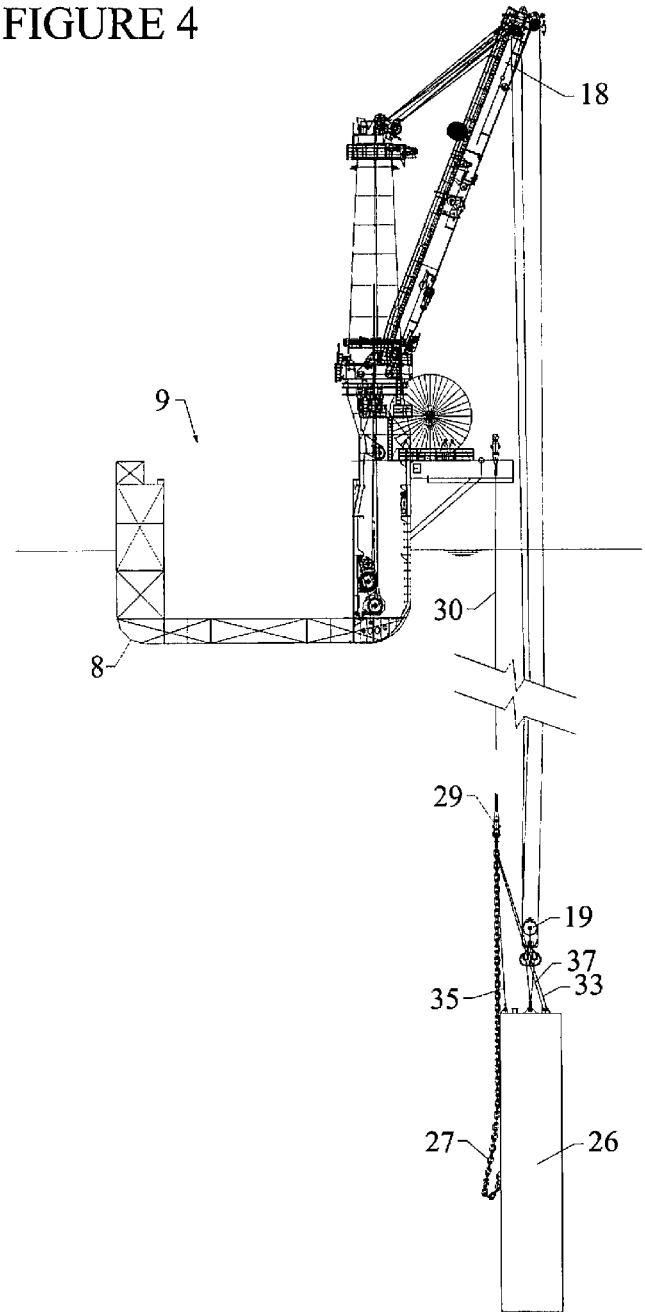
FIG. 4 shows a cross sectional view of a floating vessel with the load from the aft crane being transferred to the first polymer line connected to the hang-off on the load bearing structure.

FIG. 4 shows the suction pile 26 having reached the end of the first polymer line 30 fully deployed, such as about 1000 meters.

FIG. 4 also shows the first lift sling 33, the second lift sling 35 and the third lift sling 37 now extended while secured to the suction pile anchor chain 27, At this point, a transfer of load occurs from the aft crane main block 19 of the aft crane 18 to the first polymer line 30.

Figure 5:
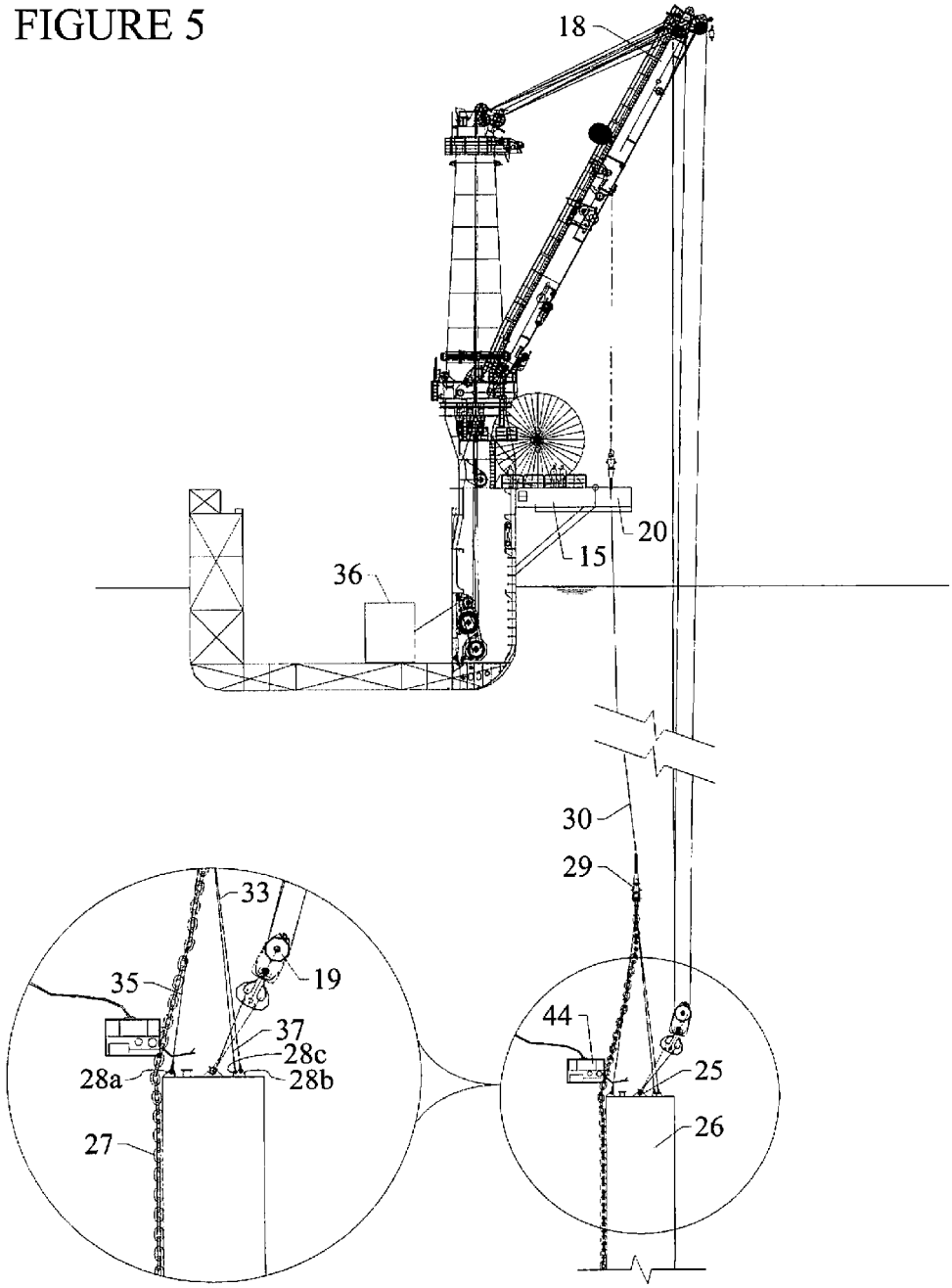
FIG. 5 shows a cross sectional view of a floating vessel with the first polymer line connected to the hang-off fully supporting the suction pile.

FIG. 5 shows the aft crane 18 with the aft crane main block 19 going slack allowing the remote operated connector 29 to support the load, shown in this Figure as suction pile 26.

A remote operated vehicle 44 is shown for disengaging the aft crane main block 19 from the suction pile's first remote operated shackle 25. In this figure, the three pad eyes 28*a*, 28*b* and 28*c* shown connected a first lift sling 33, a second lift sling 35 and a third lift sling 37, for supporting the suction pile 26 is depicted as well as the first remote operated connector 29 for use with the suction pile anchor chain 27.

It should be noted that the end of the first polymer line 30 is secured to the hang-off 20 prior to allowing the aft crane main block 19 going slack so that the hang-off can support the load from the first polymer line.

Figure 6:
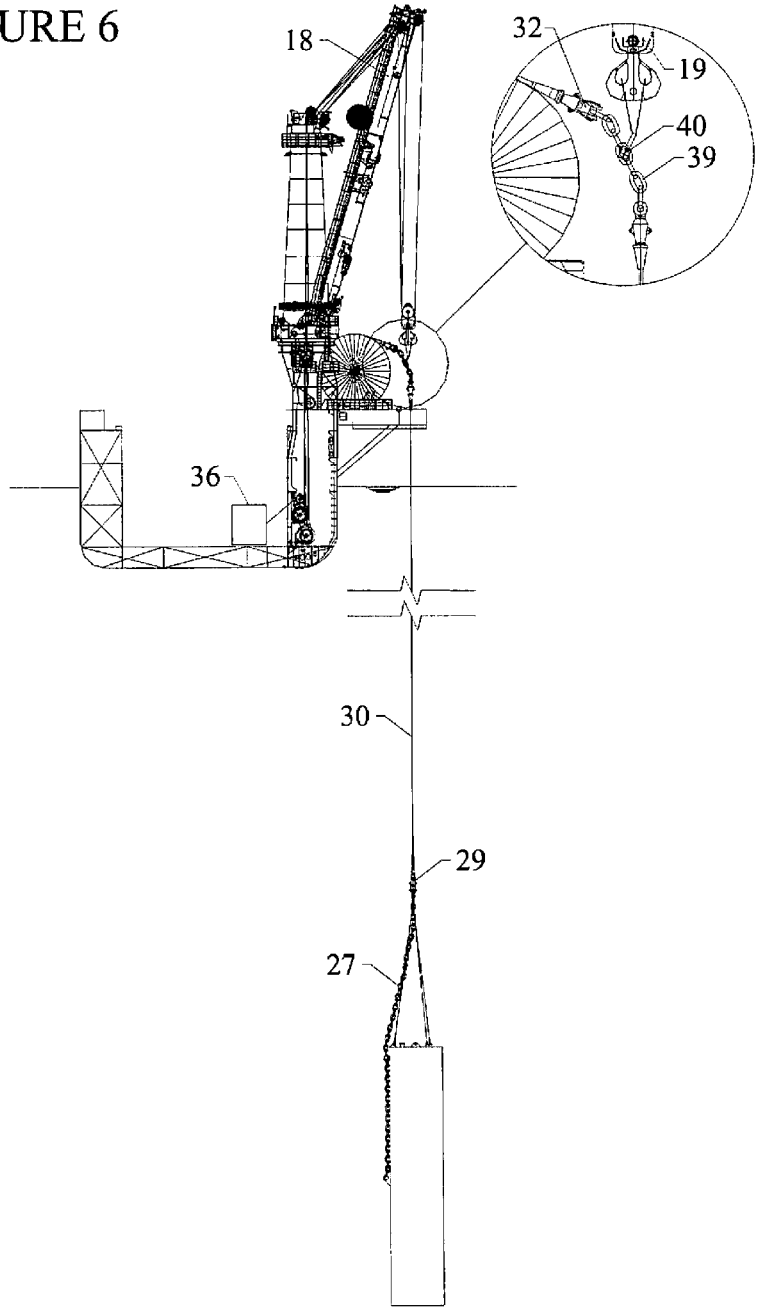
FIG. 6 shows a cross sectional view of a floating vessel with a chain segment connected between the first polymer line and a second polymer line, creating the mooring line.

FIG. 6 shows aft crane 18 with a second polymer line 32 being connected to the first polymer line 30 with a chain of the polymer line 39 and a second remote operated shackle 40, which is further shown connected to the aft crane main block 19.

Figure 7:
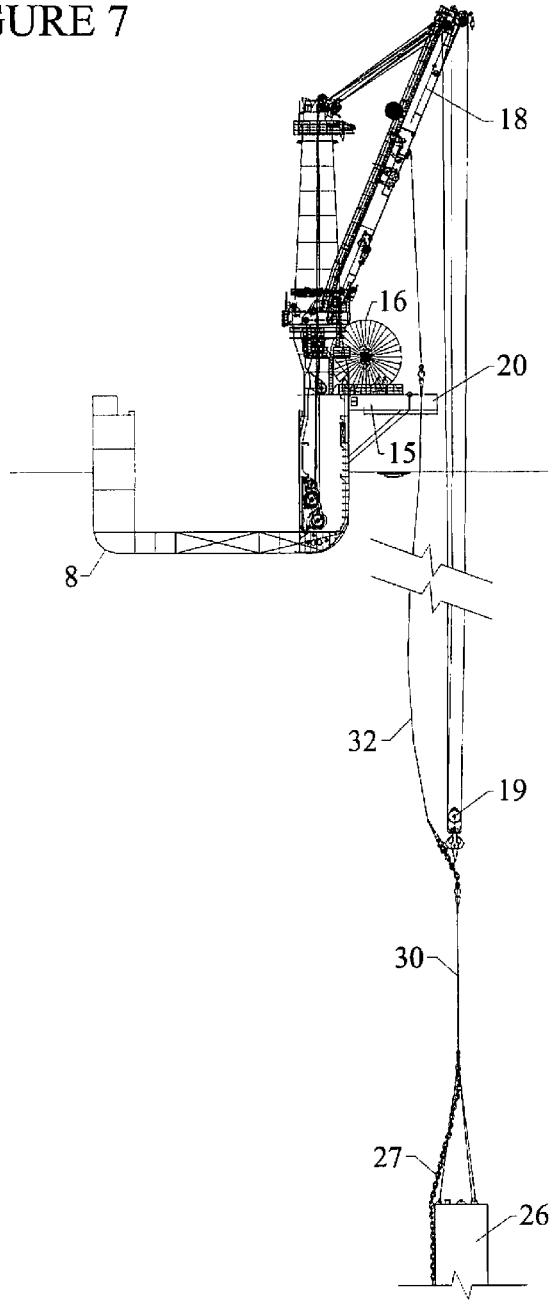
FIG. 7 depicts a cross sectional view of a floating vessel having deployed the second polymer line and the suction pile still supported by the first polymer line connected to the aft crane main block.

FIG. 7 shows the second polymer line 32 deployed from the reel drive 16 and the end of the second polymer line 32 secured to the hang-off 20 on the load bearing structure 15 while the load is off, the first polymer line 30 with suction pile 26 still supported by the aft crane main block 19 of the aft crane 18. The reel drive is adapted to first deploy a first polymer line and then deploy a second polymer line in series.

When the required depth has been reached, the end socket of the second polymer line 32 is taken from the reel drive 16. With an auxiliary hoist, the end socket of the second polymer line is placed in the hang-off 20 on the structure. Gradually the suction anchor is lowered with the aft crane main block and the load is transferred to the second polymer mooring line 32 and placed in the hang-off 20.

Figure 8:
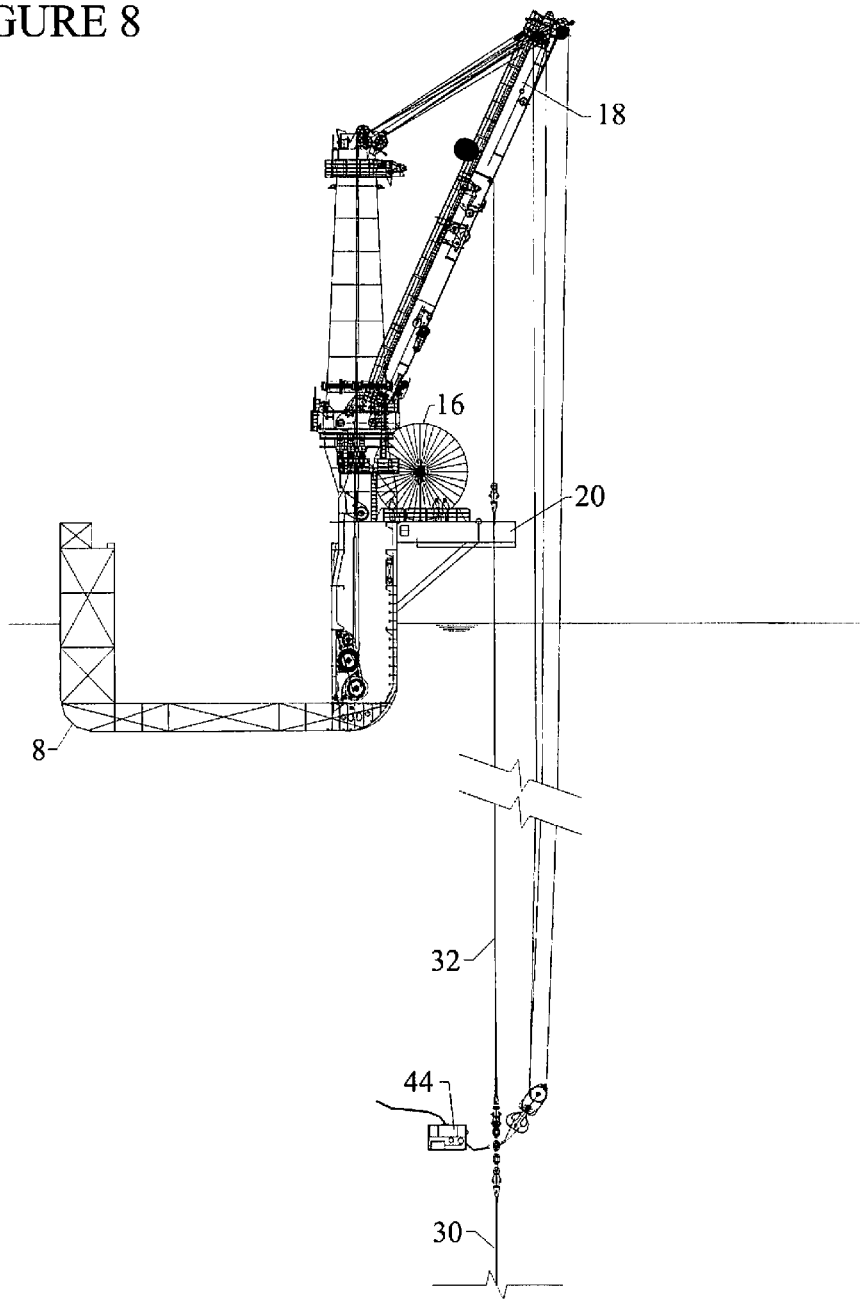
FIG. 8 depicts a cross sectional view of a floating vessel showing the aft crane main block being disconnected from the second polymer line with a remote operated shackle.

FIG. 8 shows the weight now being transferred to the hang-off 20 and the aft crane main block being slack for disconnecting from the chain by an remote operated vehicle, which was shown in greater detail in previous Figures.

Figure 9:
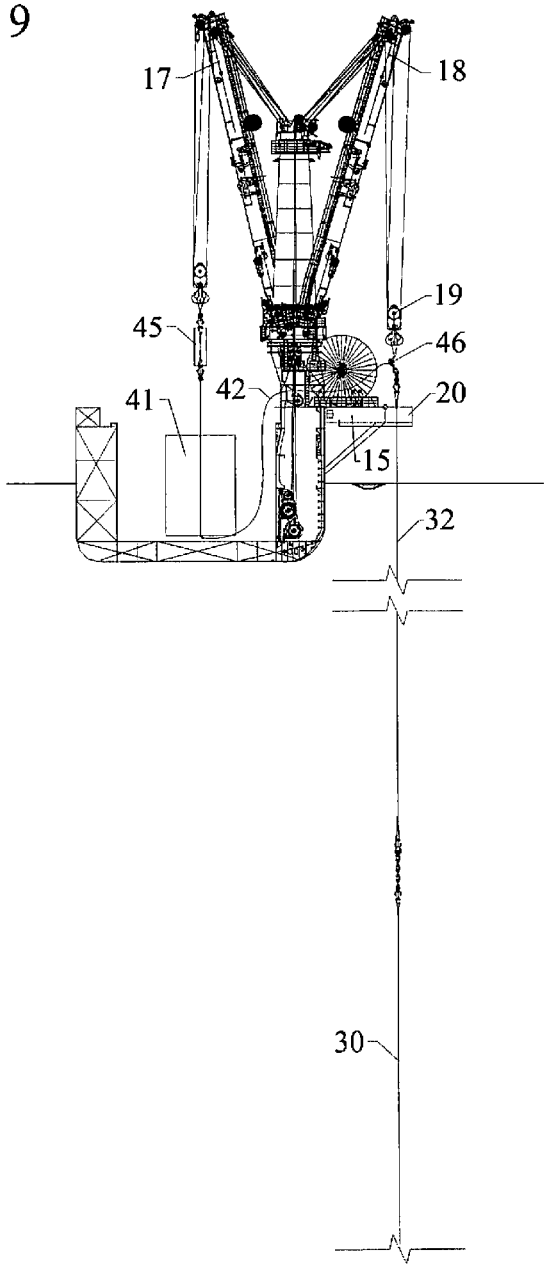
FIG. 9 is a cross sectional view of a floating vessel showing the aft crane being connected to the second polymer line connected in series to the first polymer line enabling the buoy chain to connect to the end of the second polymer line, and a fore crane lifting a buoy from the hold with a heave compensator between the lift rigging and the buoy.

FIG. 9 shows two cranes, the aft crane 18 and the fore crane 17. The fore crane 17 is shown lifting a buoy 41 from the hold of the floating vessel with a heave compensator 45 while a buoy chain 42 engaged to a buoy connector 46 is connected to the end of the load supporting second polymer line 32 that is secured to the hang-off 20. In this Figure, a connection is made between the buoy chain and the second polymer mooring line. The heave compensator can be installed in lift rigging, if required by the rolling of the sea. The fore crane lifts the buoy out of the hold of the vessel.

Figure 10:
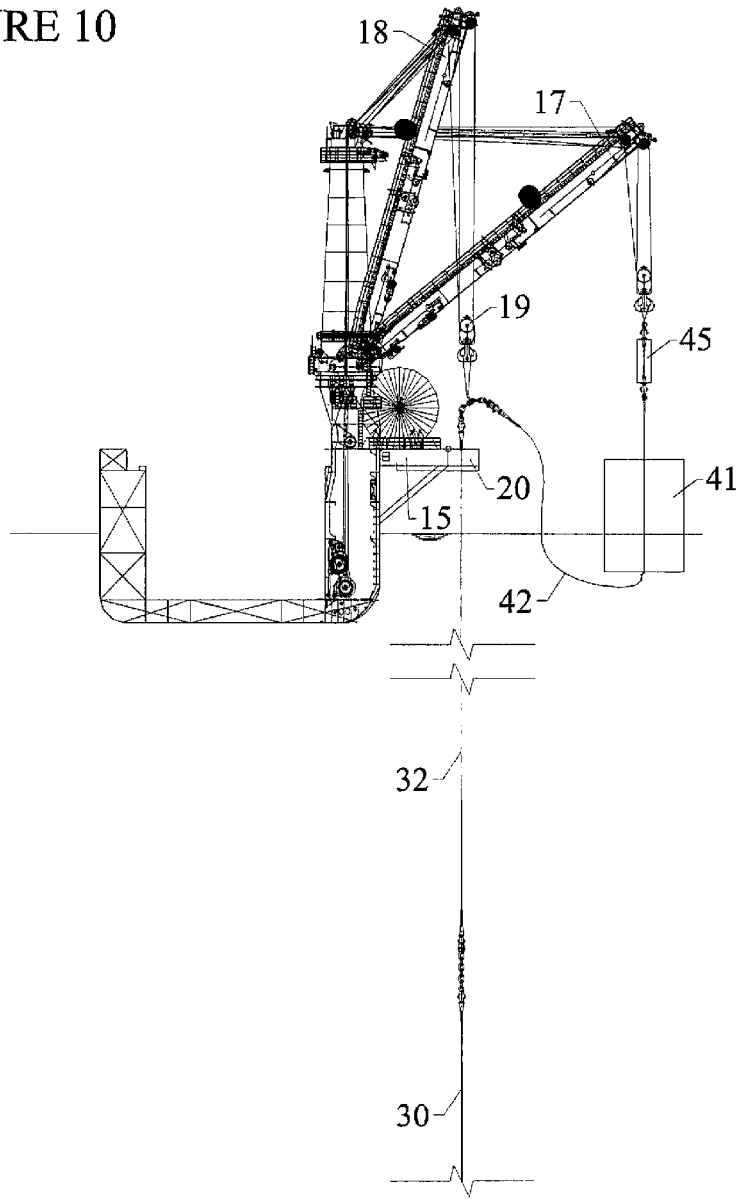
FIG. 10 is a cross sectional view of a floating vessel showing the fore crane overboarding the buoy while connected to the second polymer line and the aft crane lifting the second polymer line from a hang-off on the load bearing structure simultaneously.

FIG. 10 shows the fore crane 17 having overboarded the buoy 41 and slewed it near the hang-off 20. The aft crane 18 is used to lift the first polymer line 30 out of the hang-off 20 while supporting the load of the second polymer line 32. In an embodiment, this occurs simultaneously. That is, the fore crane 17 slews the buoy 41 close to the second polymer line 32 and the aft crane 18. The second polymer line 32 is lifted with the first polymer line 30 and suction pile and suction pile anchor chain connected to it out of the hang-off 20 while the aft crane 17 lowers the buoy 41.

Figure 11:
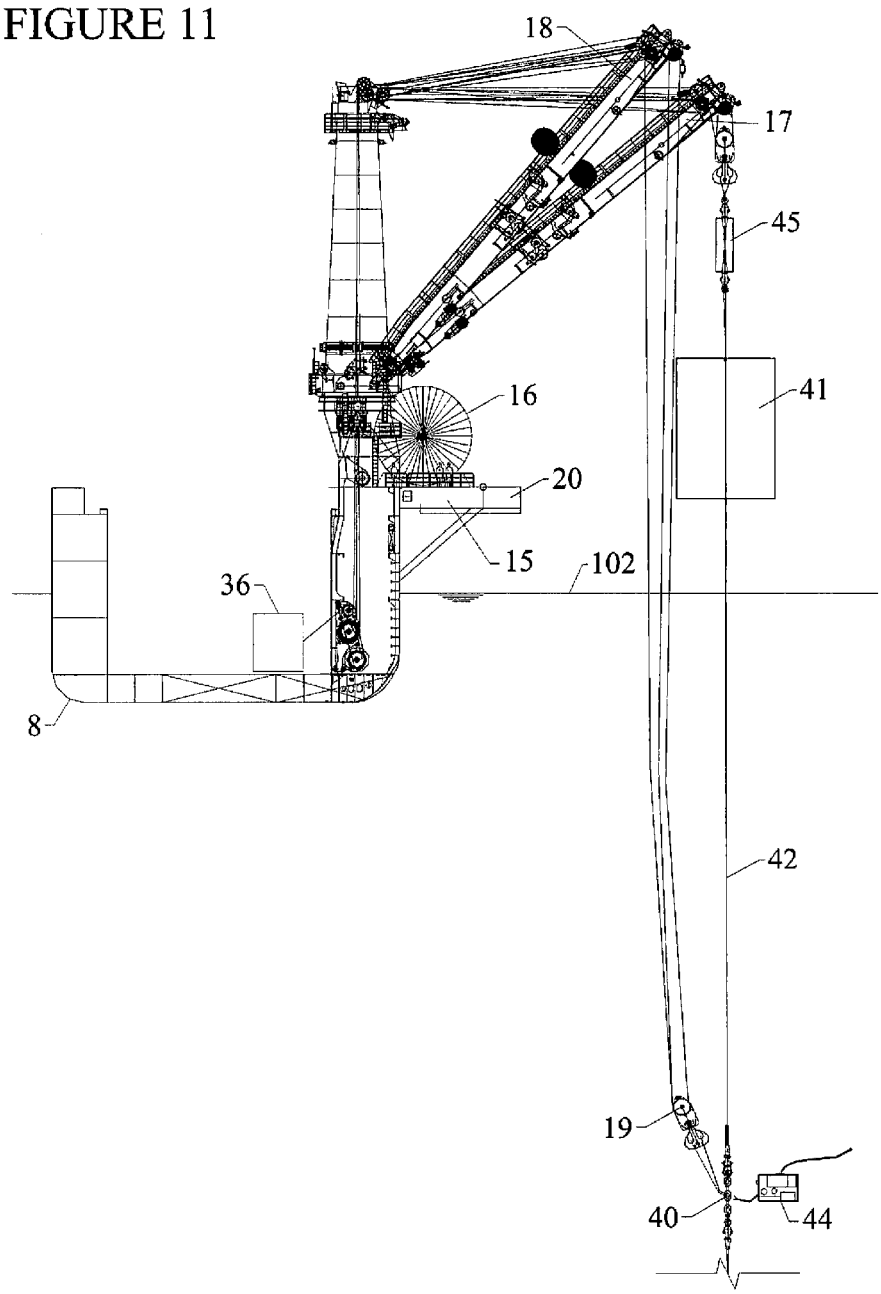
FIG. 11 is a cross sectional view of a floating vessel showing the lowering of the first and second polymer lines with the suction pile and the transferring of the load to the buoy which is supported by the fore crane enabling the suction pile supported by the polymer lines to be lowered into the sea floor.

FIG. 11 shows the fore crane 17 with the buoy 41 in the highest position and the fore crane 17 taking the load of the second polymer line 32. The aft crane main block 19 of the aft crane 18, is shown being slack and a remote operated vehicle 44 being used to disconnect the aft crane main block 19 from the polymer line.

The first and second polymer lines connected in series can then be lowered with the suction pile and the load can then be transferred to the buoy which is supported by the fore crane. The first remote operated shackle of the aft crane can then be released and the aft crane main block can be retrieved to the deck of the floating vessel. A suction pile can then be supported by the polymer lines and the fore crane can lower the suction pile to into the sea floor.

In an embodiment, the suction pile 26 can also be lowered to the sea floor with the aft crane 18 by placing the heave compensator 45 in the lift rigging. The first polymer line 30 and the second polymer line 32 must suit the water depth for the suction pile to be lowered to the sea floor.

In an additional embodiment, the suction pile 26 with the first polymer line 30 and second polymer line 32 already connected to the buoy 41 can be supported by the fore crane 17 with the heave compensator 45. The polymer lines, buoy, chains and heave compensator must suite the water depth so that the fore crane can sufficiently lower the suction pile 26 into the sea floor for full penetration.

Figure 12:
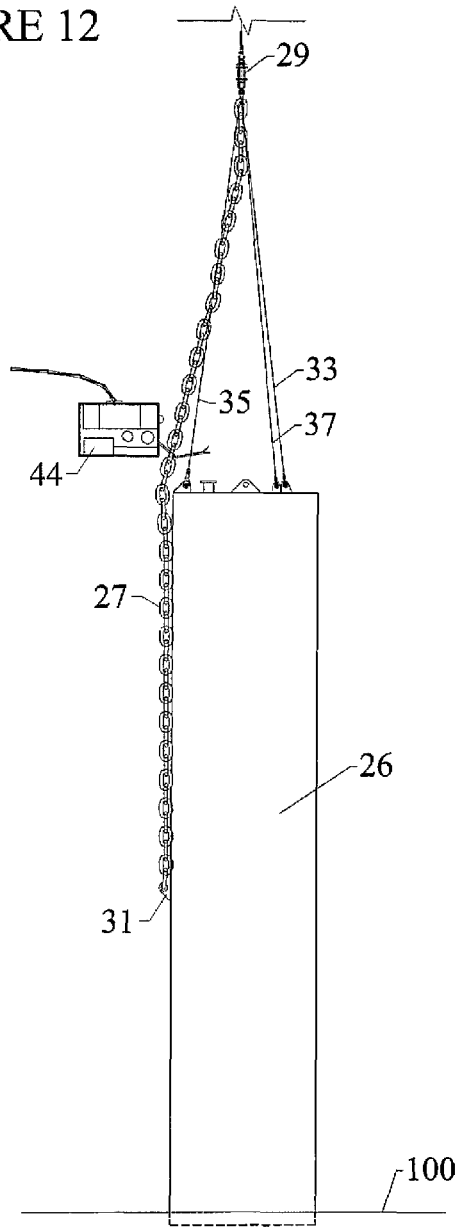
FIG. 12 shows the suction pile sunk into the sea floor under its own weight with an remote operated vehicle "ROV" for pumping water out of the suction pile.

FIG. 12 shows a detail of the suction pile 26 having just been deposited on the sea floor 100 and then sinking into the sea floor under its own weight. Also on this detail the first lift sling 33, the second lift sling 35 and the third lift sling 37, the first remote operated connector 29, the suction pile anchor chain 27 and a side pad eye 31 can be seen.

The suction pile 26 and suction pile anchor chain can be lowered with the fore crane into the sea floor until at least about 0.5 meters to about 1.5 meters of penetration occurs. The remote operated vehicle 44 can include a suction pump, not shown, which can connect to the suction pile 26. The remote operated vehicle can start its suction pump and the suction pile can be pushed into the sea floor using hydrostatic pressure. In this Figure, the three lift slings are depicted holding the suction pile 26 in a vertical position. This Figure further shows the remote operated connector 29 holding the suction pile anchor chain 27 in an almost vertical position.

Figure 13:
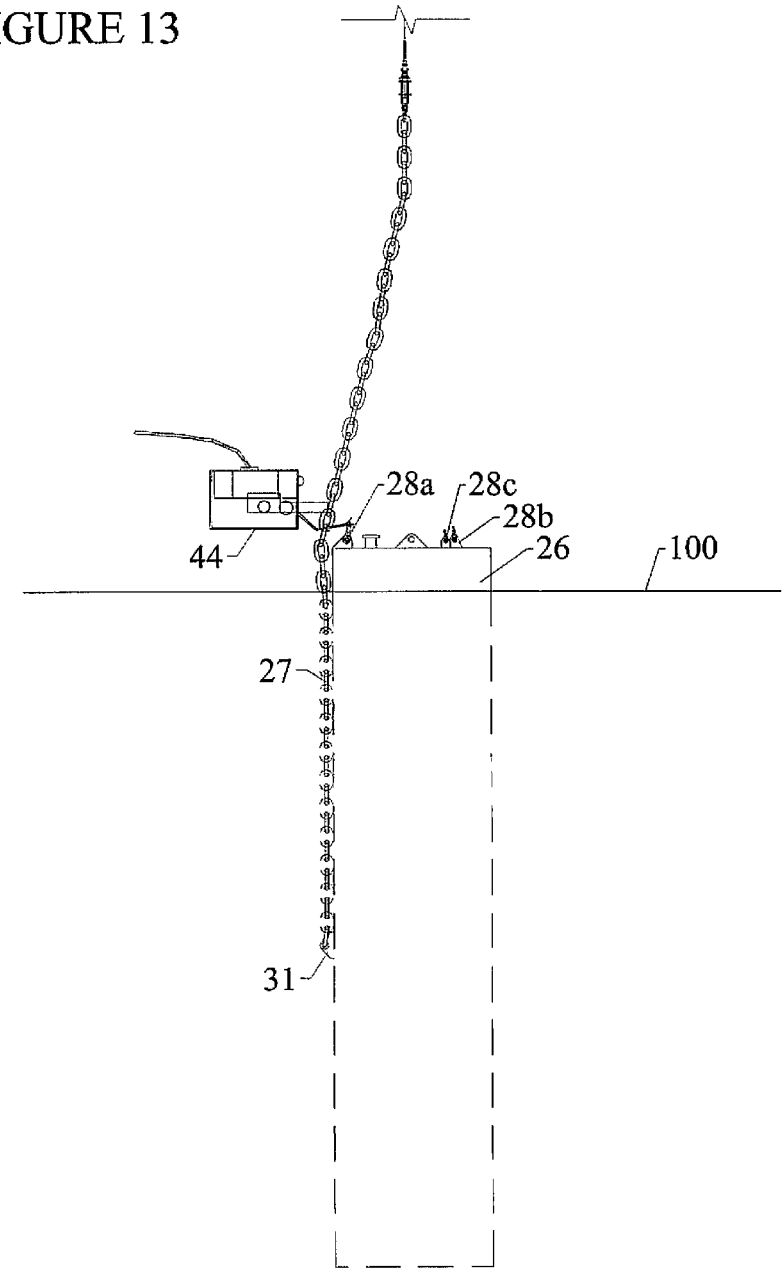
FIG. 13 shows the suction pile sunk into the sea floor and the remote operated vehicle "ROV" for disconnecting the first lift sling, the second lift sling and the third lift sling when suction pile penetration is complete.

FIG. 13 shows a detail of the remote operated vehicle 44 having pumped water out of the suction pile 26 and the suction pile now over about 80 percent sunk into the sea floor 100. Essentially, when the suction pile has reached its required depth into the sea floor, the remote operated vehicle's 44 suction pump can then be disconnected and the lift slings are cut with the remote operated vehicle and the polymer lines with the suction pile anchor chain 27 are now ready to be pre-tensioned.

In additional embodiments, a ballgrab or an alternative connector can be used to connect the suction pile anchor chain to the polymer lines. An example of a ballgrab can be one made by Balltec Ltd. However, any remote operated connector can be used with the system.

In addition, more than two buoys can be in the hold or on the deck of the floating vessel.

It should be noted that more than one deepwater deployment system can be secured in the hold enabling both cranes to lower each crane's main block to water depths of at least about 1500 meters. Each deepwater deployment system can have a winch outfitted with a lifting wire of between about 2000 meters to about 25000 meters which can be guided by sheaves to the crane jib head and lift tackle.

The polymer lines can be made of polyester, Aramide, Kevlar, or a possible composite line, such as a graphite composite material or Dyneema. Any polymer line with neutral buoyancy can be used.

Additionally in an embodiment, when the suction pile is first lowered to the sea floor and allowed to penetrate to a first depth under its own weight, this initial penetration can be between about 0.5 meters to about 1.5 meters. Once the remote operated vehicle pumps out entrapped water from the suction pile, the suction pile has penetrated into the sea floor up to about 80 percent of its body. Any remote operated vehicle can be used to pump out the entrapped water.

While these embodiments have been described with emphasis on the embodiments, it should be understood that within the scope of the appended claims, the embodiments might be practiced other than as specifically described herein.

What is claimed is:

1. A system for deploying a deepwater mooring spread from a floating vessel with a hold and deck, using a aft crane secured to a port side or a starboard side of the floating vessel, and a fore crane secured to the port side or starboard side of the floating vessel, comprising:

a. at least two suction piles and a suction pile anchor chain, at least two lift slings, at least one pad eye for each lift sling, a first remote operated shackle connected on the top of the suction pile and at least one side pad eye connecting the suction pile anchor chain to the suction pile, and a remote operated connector disposed on the top of the suction pile, wherein each suction pile is disposed in the hold or on deck of the floating vessel;

b. a load bearing structure connected to an outboard port side or an outboard starboard side of the floating vessel;

c. a hang-off connected to the load bearing structure for supporting polymer lines connected in series;

d. a reel drive fixedly secured to the load bearing structure for deploying at least one polymer line;

e. at least one buoy for each suction pile, wherein each buoy has a buoy chain;

f. at least one deepwater deployment system for one of the cranes, wherein the at least one deepwater deployment system is secured in the hold enabling at least one crane to lower the crane's main block to water depths of at least 1000 meters; and g. a plurality of remote operated connectors for: (a) engaging the first polymer line to the suction pile, (b) engaging the first polymer line to a hang-off and then a chain segment, (c) engaging the chain segment to a first end of a second polymer line, and (d) the second end of the second polymer line to the hang off or another chain segment.

2. The system of claim 1, wherein the cranes are pedestal cranes, mast cranes, or combinations thereof.

3. The system of claim 1, wherein the suctions piles are arranged vertically in the hold or on deck.

4. The system of claim 1, further comprising a remote operated vehicle (ROV) for pumping water out of the suction piles to penetrate the suction piles into a sea floor.

5. The system of claim 1, further comprising a chain connected between the polymer lines connected in series.

6. The system of claim 5, further comprising a connector disposed between the chain and the polymer line connected in series.

7. The system of claim 6, wherein each crane comprises a main block for securing to the connectors of the suction piles, polymer lines, or chain between polymer lines.

8. The system of claim 1, wherein the polymer lines are used as pennants to lower the suction piles to unlimited water depths, and wherein the polymer lines are almost buoyant neutral adding no weight to the cranes.

9. The system of claim 1, wherein the reel drive is adapted to first deploy a first polymer line and then deploy a second polymer line in series.

* * * * *